United States Patent [19]

Griffiths

[11] 4,158,984

[45] Jun. 26, 1979

[54] METHOD OF BRAIDING

[75] Inventor: Leonard W. Griffiths, Canton, Wales

[73] Assignee: Aeroquip Corporation, Jackson, Mich.

[21] Appl. No.: 884,643

[22] Filed: Mar. 8, 1978

[30] Foreign Application Priority Data

Mar. 9, 1977 [GB] United Kingdom ..... 10000/77

[51] Int. Cl.[2] ..... D04C 3/06; D04C 3/12; D04C 3/40; D04C 1/06

[52] U.S. Cl. ..... 87/8; 87/6; 87/9; 87/11; 87/29; 87/44

[58] Field of Search ..... 87/11, 37, 38, 41, 44, 87/6–9, 29

[56] References Cited

U.S. PATENT DOCUMENTS

| | | | |
|---|---|---|---|
| 2,148,164 | 2/1939 | Krippendorf | 87/37 |
| 2,354,212 | 7/1944 | Jeckel | 87/11 |
| 2,388,693 | 11/1945 | Jeckel | 87/11 X |
| 2,879,687 | 3/1959 | Leimbach et al. | 87/11 X |

*Primary Examiner*—John Petrakes

*Attorney, Agent, or Firm*—Fleit & Jacobson

[57] ABSTRACT

A method of braiding yarns wound on a plurality of carriers arranged in groups as two sets of carriers, the sets moving in opposing directions along continuous, sinusoidal, overlapping paths, such that the spacing of the carriers in a group within at least one set differs from the spacing of adjacent groups within that set.

11 Claims, 3 Drawing Figures

METHOD OF BRAIDING

The present invention relates to a method of braiding, and also to braid patterns produced by such method.

In the Specification, "yarn" will be used to describe any form of thread or wire, having one or more strands, and which may be made of, for example, metal e.g. steel, glass or textile material.

In a braiding machine, a number of threads of yarn are each wound onto a yarn carrier, which is a spool which holds the yarn and releases it under a given tension, each carrier being movable in a generally circular path about a base plate of the machine. To produce the braiding pattern, the carriers are divided into two sets, one set travelling in a clockwise direction along an annular sinusoidal path on the base plate of the machine, while the other set travels in an anticlockwise direction about a similar path, these two paths crossing one another at a number of points during one revolution.

In conventional braiding machines, all the carriers travelling in a given direction along a path in the base plate are positioned equidistant from one another. Such a method of braiding produces a pattern in which a yarn passes alternately over two yarns and then under two yarns wound in the opposite direction. The number of yarns that are used determines the density of braid that results.

Braiding may be used to cover a rubber tube such that it will produce reinforcement for the tube so that it may withstand a greater pressure of fluid within the tube. Difficulties occur if the braid is not sufficiently dense such that gaps or interstices occur between adjacent woven yarns. The occurrence of such interstices in the braiding pattern means that the burst pressure of the tube is significantly decreased. This can be avoided by "double braiding" in which a second layer of braid is woven over the first layer of braid covering a rubber tube, such that the interstices of one layer are covered by yarns of another. However, this method has a number of disadvantages, in that the double layer decreases the flexibility of the tubes so produced, and increases the weight of the tube; moreover the cost of materials and apparatus to produce such a double layer of braiding is greatly increased.

To ensure a high burst pressure for a braided rubber tube, high tensile wire should be used to produce the braiding. However, such wire usually has low ductility, thereby making it unsuitable for this use.

According to the present invention there is provided a method of braiding yarns wound on a plurality of carriers, comprising moving a first set of carriers, each having yarn wound thereon, along a first annular, sinusoidal closed path in a given first direction, and moving a second set of carriers, each having yarn wound thereon, along a second annular, sinusoidal closed path in an opposite direction, the second path intersecting at a plurality of points with said first path, the carriers of each set travelling in groups; wherein the spacing of the carriers in a group within at least one set is different from the spacing of adjacent groups within that set.

A group in each set may have any number of yarns. Advantageously, when only one set has differing spacing as described before, one set contains groups of three yarns while the other set contains groups of single yarn, the resultant being termed as "three and one" braid pattern.

This pattern comprises a group of three yarns of one set passing under and over each group of single yarn of the other set, the braid pattern not being symmetrical. Such a braid could be considered as comprising a helix formed by the group of three yarns, the single yarn being used as a binder for the group of three yarns. The resultant hose is a form of helical tubing which may have great resistance to flexing under pressure impulse conditions.

Alternatively, both sets may have differing spacing as described before, and preferably each group of both sets contains two yarns, the resultant being termed a "two and two" braid pattern.

This braid pattern comprises two yarns of one set alternately passing over and under two yarns of the other set. Such a braid pattern is symmetrical and is suitable for manufacturing either single or double braid.

Such a braid construction may provide improved flexibility for hoses covered with such braiding and moreover there can be a reduction in the number of braid cross-over points so that the impulse fatigue life under flexing conditions can be greatly improved.

Furthermore, because of the reduction in the amount of braid cross-over points high tensile wire can be used for the braiding even though it may have a low ductility, therefore producing hoses having a greater resistance to fluid pressure.

Preferably each path is sinusoidal and describes a circle having a common centre point on the base plate of the machine.

The yarn of one set may be of a different material from that of the yarn in the other set. Preferably, for example, the yarns of the three yarn set are of an ultra high tensile wire with poor ductility, while the yarn of the single yarn set may be of a low tensile steel, stainless steel or textile but may have an improved ductility over the high tensile wire. Such a construction would make the best use of the properties of the materials, for higher tensile wires tend to have low ductility, therefore making it harder for them to be used in braiding.

According to another aspect, there is provided braiding produced by the method of the present invention.

According to a further aspect, there is provided a braiding machine comprising means adapted for moving a set of carriers along a first, annular, closed sinusoidal path in a given first direction and for moving a second set of carriers along a second annular, sinusoidal closed path in an opposite direction such that, in use:

(a) the second path intersects at a plurality of points with said first path;

(b) the carriers of each set travel in groups and (c) the spacing of the carriers in a group within at least one set is different from the spacing of adjacent groups within that set.

In order that the invention may more readily be understood, a description is given, by way of example only, reference being made to the accompanying drawings, in which.

Figure 1:
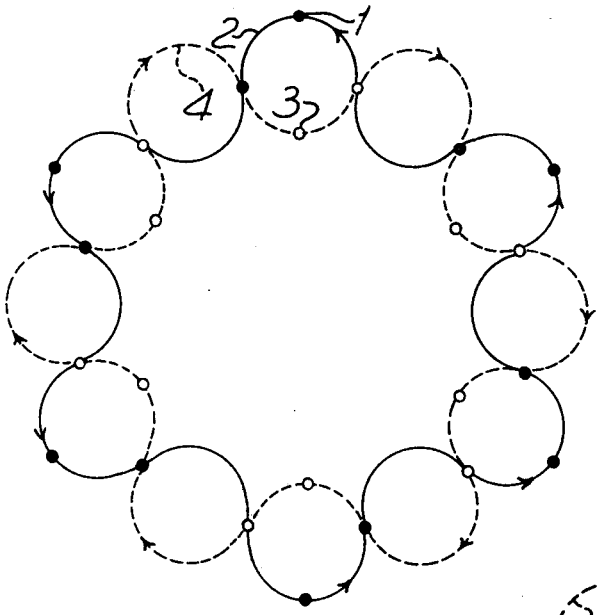
FIG. 1 is a diagrammatic view of the relative paths of two sets of carriers in a "two and two" method of braiding according to the present invention.
Figure 2:
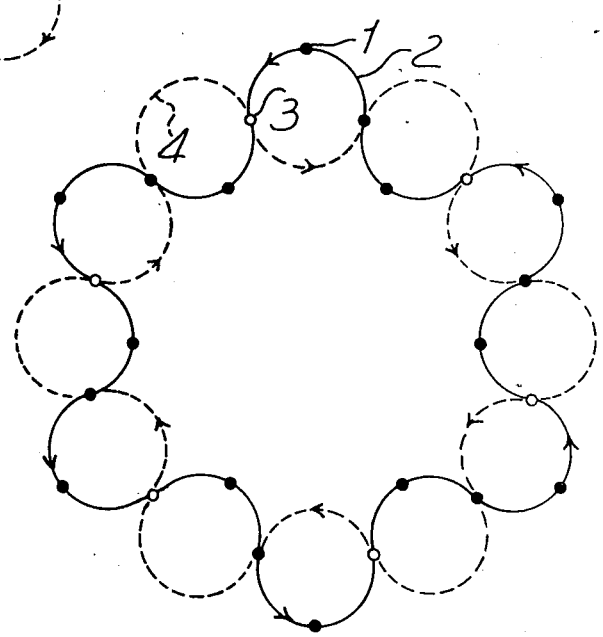
FIG. 2 is a diagrammatic view of the relative paths of the two sets of carriers in a "three and one" method of braiding according to the invention.

Each of FIGS. 1 and 2 illustrate the relative paths of two sets of yarn carriers about a base plate of a braiding machine. One set of carriers, as generally designated by the numeral 1 and represented diagrammatically by a black spot, travel along a sinusoidal path (represented by a continuous black line) which describes a substantially circular outline about a centre point on the base plate of the machine. A second set of yarn carriers 2 are represented by a white dot and travel in a clockwise direction along a similar path (represented by a dotted line) to that of the carriers 1 and having the same centre point, the two paths intersecting at a number of points.

FIG. 1 shows an arrangement of carriers to be used in a method of braiding according to the invention, in which the carriers 1 are positioned such that they form groups, each group containing two carriers spaced from one another by one quarter of a pitch. By "pitch" is meant the path length of one wavelength of the sinusoidal path. Each of such groups is spaced from its neighbour along the path 2 by a distance equivalent to three quarters of a pitch. Likewise, the carriers 3 are also positioned in groups of two, the carriers of a group being spaced apart by a distance of a quarter of a pitch and adjacent groups along the path 4 being spaced from one another by three quarters of a pitch. The resulting braiding pattern comprises two yarns from carriers 1 passing over and under two yarns from the carriers 3, this pattern being symmetrical.

This pattern has half the number of braid cross-over points as compared to a conventional pattern, the yarns from each group of carriers merging to form a tight bundle with twice the number of ends normally achieved.

An alternative arrangement of yarn carriers is illustrated in FIG. 2, in which each group of carriers 1, travelling in the anticlockwise direction comprises three such carriers, being spaced apart by a quarter of a pitch and each of the groups being spaced apart by one half of a pitch from the adjacent groups along path 1. Each group of carriers 3, travelling in the clockwise direction, has only a single carrier, while adjacent groups are spaced along the path 4 by a distance equivalent to a complete pitch. The resulting braid pattern comprises a single yarn from carrier 3 passing over and under a group of three yarns from carriers 1, and is in the form of a helix produced by the three yarns being bound by the single yarn (forming a binding yarn), the pattern not being symmetrical. This form of braid is preferably used as one layer in a double layer of braid, the other layer being formed by having a single layer in each group for the carriers 1 travelling anticlockwise, and having three yarns in each group for the carriers 3 travelling clockwise, so that the resulting layer of braid is symmetrically opposed to that of the first layer, and therefore will overlap and interlock with it. With this pattern the binding yarn can be made of a more ductile material than the other three yarns which form the main reinforcement.

Figure 3:
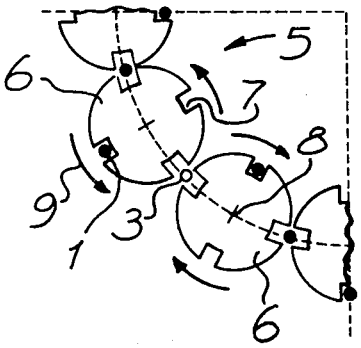
FIG. 3 is a plan view of a section of a braiding machine for the "three and one" method.

FIG. 3 illustrates a section of the baseplate (generally designated by numeral 5) of a conventional braiding machine adapted to employ the "three and one" method of the invention. A number of feed discs 6 are mounted on baseplate 5 for rotation about an axis through the centre point 8 of disc 6 and are positioned so that centre points 8 describe a circle in baseplate 5. Each feed disc has four grooves 7 on the periphery at the extremities of two diameters of the disc at right angles to one another, feeding carriers 1 and 3 along tracks cut into baseplate 5 corresponding to the paths 2 and 4 shown in FIG. 2. Adjacent discs 6 rotate in opposite directions as shown by arrows 9.

To adapt a conventional braiding machine, it is necessary to rearrange the carriers 1 and 3 in the tracks such that each set of carriers moves along its respective track in groups as described before, with groups of carriers 1 and carriers 3 alternately passing a common point on the tracks where the two paths 2 and 4 intersect.

The method of the present invention can be used in most conventional binding machines, for example, those having 12, 20, 24, 32, 36 and 48 carriers for each baseplate.

I claim:

1. A method of braiding yarns on a machine having a first set of carriers and a second set of carriers, a plurality of groups of carriers forming each set, within each set the groups having a constant, equal number of carriers, each of said carriers having yarn wound thereon, the method comprising: moving the first set of carriers along a first, annular, sinusoidal closed path in a given first direction and moving the second set of carriers along a second annular, sinusoidal closed path in an opposite direction, the second path intersecting at a plurality of points within said first path; wherein the spacing of the carriers travelling in a group within at least one set is constant, while differing from the spacing between adjacent groups of that set.

2. A method according to claim 1, wherein the yarn wound on the carriers of the first set is of a differing material to that yarn wound on the carriers of the second set.

3. A method according to claim 1, wherein a group of the first set comprises three carriers.

4. A method according to claim 3, wherein the yarn of the first carrier set is a high tensile wire with low ductility, and the yarn of the second set is a low tensile wire with high ductility.

5. A method according to claim 1, wherein a group of the second set comprises one carrier.

6. A method according to claim 1, wherein a group of the first set comprises two carriers.

7. A method according to claim 1, wherein a group of the second set comprises two carriers.

8. A method according to claim 1, wherein the centre of each carrier describes a circular path.

9. A method according to claim 1, wherein the distance between carriers in a group is a quarter pitch.

10. A method according to claim 1, wherein following said moving steps, a further braid pattern is produced by moving the first set of carriers along said first path in the opposite direction, and moving the second set of carriers along said second path in said first direction, to thereby produce a braid pattern similar to that produced by the first mentioned moving steps and of opposite twist.

11. A braiding machine having means for moving a set of carriers along a first, annular, closed sinusoidal path in a given first direction and for moving a second set of carriers along a second, annular sinusoidal closed path intersecting at a plurality of points with said first path, the carriers of each set being arranged to travel in groups each of the groups in a set having a constant, equal number of carriers; and the spacing of the carriers in a group within at least one set being constant as the group moves along the path of the set to which it belongs and differing from the spacings between adjacent groups within that set.

* * * * *